US006195011B1

(12) United States Patent
Winterble et al.

(10) Patent No.: US 6,195,011 B1
(45) **Date of Patent: *Feb. 27, 2001**

(54) EARLY FIRE DETECTION USING TEMPERATURE AND SMOKE SENSING

(75) Inventors: Charles B. Winterble, Princeton; Rony R. Seyouri, Framingham, both of MA (US)

(73) Assignee: Simplex Time Recorder Company, Westminster, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/165,485

(22) Filed: Oct. 2, 1998

Related U.S. Application Data

(63) Continuation-in-part of application No. 08/677,339, filed on Jul. 2, 1996, now Pat. No. 5,818,326.

(51) Int. Cl.[7] ..... G08B 17/10

(52) U.S. Cl. ..... 340/589; 340/511; 340/522; 340/578; 340/628

(58) Field of Search ..... 340/286.05, 627, 340/628, 629, 630, 632, 521, 522, 523, 577, 578, 584, 588, 589; 250/521, 522, 254

(56) References Cited

U.S. PATENT DOCUMENTS

| | | | |
|---|---|---|---|
| 3,882,477 | 5/1975 | Mueller | 340/237 |
| 4,088,986 | 5/1978 | Boucher | 340/237 |
| 4,225,860 | 9/1980 | Conforti | 340/629 |
| 4,254,414 | 3/1981 | Street et al. | 340/627 |
| 4,349,812 | 9/1982 | Healey et al. | 340/522 |
| 4,401,978 | 8/1983 | Solomon | 340/628 |
| 4,405,919 | 9/1983 | Scheidweiler | 340/522 |
| 4,639,598 | 1/1987 | Kern et al. | 250/339 |
| 4,640,628 | 2/1987 | Seki et al. | 374/141 |
| 4,644,331 | 2/1987 | Matsushita et al. | 340/587 |
| 4,709,229 | 11/1987 | Otsuka | 340/540 |
| 4,745,399 | 5/1988 | Kimura | 340/521 |
| 4,749,987 | 6/1988 | Ishii | 340/587 |
| 4,796,025 | 1/1989 | Farley et al. | 340/825 |
| 4,884,222 | 11/1989 | Nagashima et al. | 364/550 |
| 5,260,687 | 11/1993 | Yamauchi et al. | 340/522 |
| 5,589,824 | 12/1996 | Lynch | 340/628 |
| 5,592,147 | 1/1997 | Wong | 340/522 |
| 5,691,703 * | 11/1997 | Roby et al. | 340/628 |
| 5,767,776 * | 6/1998 | Wong | 340/632 |
| 5,798,700 * | 8/1998 | Wong | 340/628 |
| 5,801,633 * | 9/1998 | Soni | 340/628 |

FOREIGN PATENT DOCUMENTS

| | | | |
|---|---|---|---|
| WO 96/41318 | 12/1996 | (WO) | G08B/17/10 |

OTHER PUBLICATIONS

G. Heskestad, et al., "Fire Detection Using Signal Cross Correlation Techniques," *Technical Report, FMRC J.I. OROR8.RU, Factory Mutual Research,* pp. i–xi–a (May 1990).

H. Ishii, et al., "An Algorithm for Improving the Reliability of Detection with Processing of Multiple Sensors' Signal," *Fire Safety Journal 17,* pp. 469–484 (1991).

* cited by examiner

*Primary Examiner*—Daniel J. Wu
(74) *Attorney, Agent, or Firm*—Hamilton, Brook, Smith & Reynolds, P.C.

(57) ABSTRACT

A fire detection system cross correlates the responses of a temperature and smoke sensing units to achieve early-detection characteristics. The system also performs threshold-type detection on the smoke obscuration, temperature, and rate of temperature rise. If any of the thresholds are surpassed, the same alarm condition will be set. As a result, the detection characteristics of the resulting detector can be no worse than the conventional threshold-only systems. The system advantageously, however, provides for the early detection of fires that satisfy the cross correlation characteristics. Thus, it achieves the best performance characteristics of both approaches.

14 Claims, 3 Drawing Sheets

EARLY FIRE DETECTION USING TEMPERATURE AND SMOKE SENSING

RELATED APPLICATION

This application is a Continuation-in-part of U.S. Ser. No. 08/677,339, filed Jul. 2, 1996, now U.S. Pat. No. 5,818,326 the entire teachings of which are incorporated herein by reference.

BACKGROUND OF THE INVENTION

Most fire detection systems generate an alarm condition in response to a measured environmental factor that indicates the existence of a fire. Photoelectric smoke detectors, for example, determine a light obscuration level in sampled air and trigger an alarm condition when this obscuration exceeds some predetermined threshold. In most cases, the obscuration is due to smoke in the atmosphere. Many thermal fire detectors operate on a similar principle. They will trigger the alarm when the measured ambient temperature reaches 130° F., for example.

One improvement to these threshold-based detector systems is the maintenance of a running average or quiescent value against which each current sample is compared. For example, in the smoke detectors, a long-term running average, over 24 hours for example, is kept for the detected obscuration levels, and the current sample is compared against this average. An alarm condition is generated when a current sample exceeds this average obscuration by the threshold, which does not change in time. The advantage of this approach is that the smoke detectors will maintain substantially the same sensitivity over time, mitigating the effects of aging and dirt accumulation in the detection chamber.

A similar approach is taken with the heat detectors. The time period over which the running average is kept, however, tends to be shorter to account for the fact that the temperatures within buildings change across a 24 hour period. Thus, the smoke detector will have substantially the same sensitivity at night, when the building is cold, and during the day when the building tends to be hotter.

In order to improve early detection capabilities, various systems have been proposed that generate alarms based not upon the net level of the sampled physical phenomenon but on the changes or trends in the sampled data. One of the earliest examples of this type of system is disclosed in U.S. Pat. No. 4,254,414 to Street, et al. The disclosed processor-aided fire detector tracks the sample-to-sample changes in the detected obscuration levels. The detector generates various levels of alarms based upon the time over which the atmospheric obscuration has been continuously increasing. Rate-of-rise temperature detectors rely on a similar approach. These devices generate an alarm when the temperature is increasing quickly over a defined period of time. The assumption is that this rapid temperature rise is, with high probability, initiated by fire.

In general, these trend-based devices tend to have good early detection characteristics, but can be subject to higher instances of false alarms. It is problematic to filter the data to ensure that random events occurring over the course of years do not satisfy the trend criteria necessary to activate the alarm.

In order to improve the fire detector's resistance to false alarms and improve uniformity over a wide range of fire types, a number of different approaches have focused on generating alarms based upon the outputs of two or more sensors. Researchers have studied the cross correlations between the changes in temperature; smoke density according to extinction effects or scattering effects; effects on ion flow in a measuring ionization chamber; and concentrations of carbon monoxide, carbon dioxide, total hydrocarbons, and oxides of nitrogen as predictors of fire. See *Fire Detection Using Signal Cross Correlation Techniques*, by G. Heskestad, et al., Factory Mutual Research Corporation.

SUMMARY OF THE INVENTION

Fire detection systems that rely on the response signals of multiple sensors can have excellent early fire detection capabilities for specific fires. Based upon the nature and contents of a protected area, a detector that monitors the trends in the data from multiple sensors can be selected to sensitize the system to a typical fire in that location.

In some instances, the characteristics and nature of a potential fire can be predictable. Certain physical phenomena, such as heat and smoke, show definite correlated trends in known directions. The use of cross correlation or covariance type functions can utilize this feature to provide an excellent early warning response. However, a cross correlation type detection scheme that is optimized for one type of fire will not work as well for other types. In situations where a fire does not create significant levels of either of the physical phenomena which are sensed by the detector, the case may arrive that the correlation scheme will not work as rapidly as the conventional threshold or rate of rise schemes or it might not work at all. For example, in a given location, there may be a high risk of a wood consuming fire. A cross correlation between changes in carbon monoxide concentrations and changes in ionization would be an excellent basis for early detection for this type of fire. If the fire source were ethanol, however, this cross correlation would perform poorly. In some cases, it may respond more slowly than conventional detection systems. Such a tradeoff is unacceptable.

The present invention solves this problem by comparing the responses of different sensors over time to achieve the early-detection characteristics associated with this type of system. This can be achieved with a cross correlation or covariance function, for example. The system, however, also performs conventional threshold or rate of rise type detection. If the thresholds are surpassed for any one of the sensors, the alarm condition will be set. Effectively the invention incorporates each type of detection scheme: threshold, rate of rise, and a cross correlation type function, and continually tests for an alarm condition generated by any one of them. As a result, the detection characteristics of the resulting system can achieve the early detection associated with a cross correlation or covariance type function but still rely on the conventional threshold or rate of rise type detection. Thus, it achieves the best performance characteristics of both approaches.

In general, according to one aspect, the invention features a fire alarm system. This system includes at least two sensing units that detect different physical quantities associated with fire. In specific embodiments, the units detect smoke and temperature. An alarm condition may be set if either physical quantity exceeds the associated thresholds for the quantities. A controller, however, additionally compares the changes in the detected quantities over time. An alarm condition will be set if these changes are indicative of a fire. Thus, an alarm condition may be triggered upon the occurrence of any one of three events.

In other embodiments, the smoke detection may be made less subject to false alarms due to transient smoke by only setting the alarm condition after detecting smoke for longer than a single sampling period.

In still other embodiments, rate of temperature rise detection may also be used. Here again, false alarm immunity may be added by only setting the alarm condition after the threshold rate of rise has been exceeded for longer than a single sampling period.

The invention may also be characterized as a method for detecting fire and setting a fire alarm condition. This method includes detecting a first physical quantity associated with fire, smoke for example, and setting an alarm condition if the first physical quantity exceeds a first threshold. A second physical quantity associated with fire, temperature for example, is also detected and an alarm condition set if the second physical quantity exceeds a second threshold. Finally, the changes in the detected first and second physical quantities are compared to each other. An alarm condition is also set if the changes are indicative of a fire.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

Figure 1:
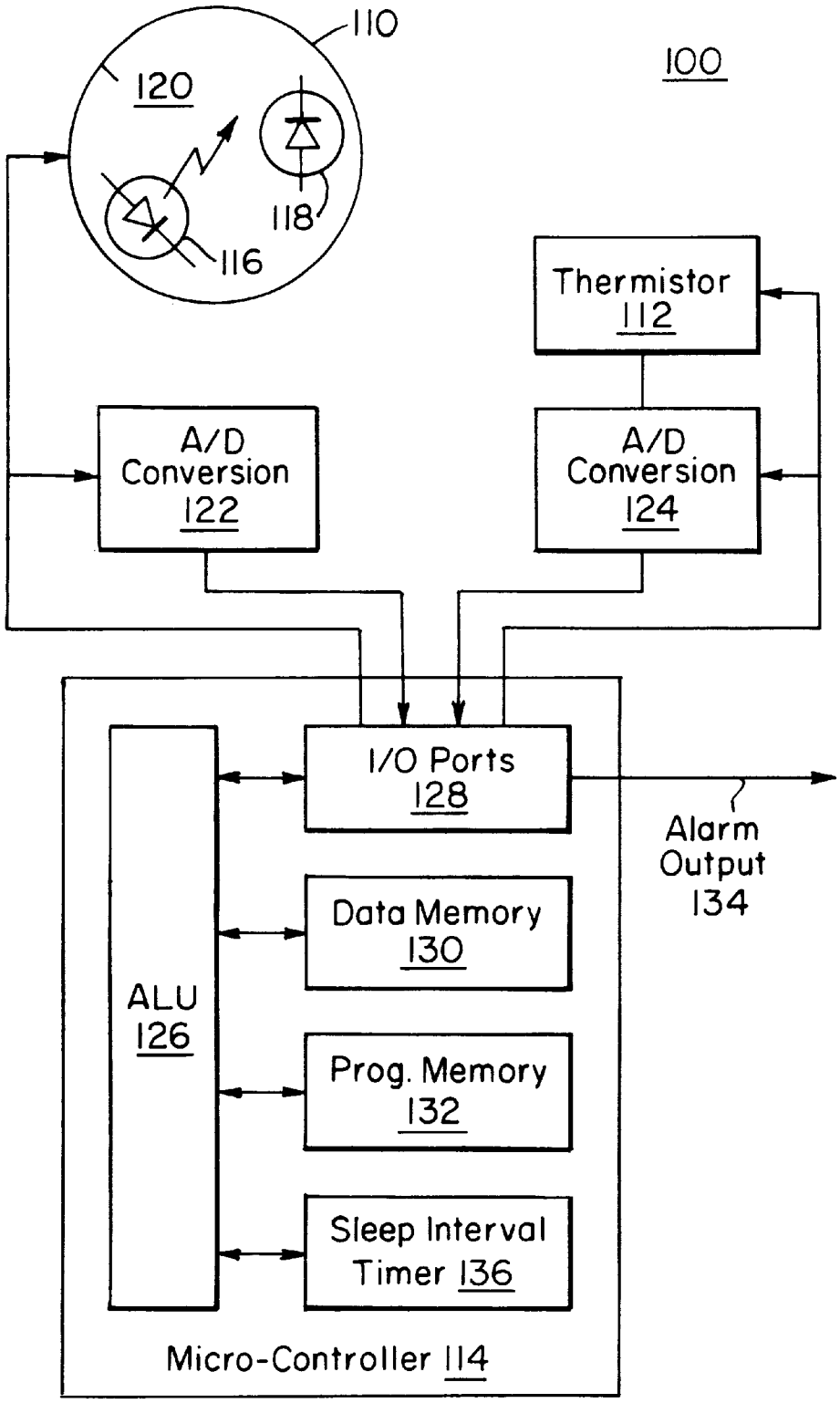
FIG. 1 is a block diagram of a smoke and heat cross correlation fire detection system of the present invention.

FIG. 1 shows a fire detector 100 which has been constructed according to the principles of the present invention. Principally, the detecting system 100 comprises a photoelectric smoke sensing unit 110, a heat sensing unit 112, and a microcontroller 114 that sets an alarm condition in response to the signals provided by the smoke and heat sensing units.

In more detail, the smoke sensing unit 110 is preferably a scattering-type photoelectric smoke sensor. These units typically have a light emitting diode 116 and photosensitive diode 118 located in a detection chamber 120, which blocks ambient light but through which air from the environment may circulate. The light emitting diode 116 and photodiode 118 are oriented within the chamber so that light from the diode 116 can not directly reach the photodiode 118. Smoke in the chamber, however, will scatter light from the light emitting diode toward the photodiode. In this way, the level of smoke, or similar light scattering particles, in the surrounding environment may be sampled.

Other types of smoke detectors may be alternatively used. For example, ionization-type detectors could also be used. Attenuation-type photoelectric smoke detection units, in which the light emitting diode directs light at the photodiode, can be used. The attenuation of the light emitting diode's signal is then a function of the level of smoke in the surrounding environment. Further, combinations of these detectors are also possible.

In any case, the smoke sensing unit 110 generates an analog signal, in response to activation by the microcontroller, that is indicative of the smoke concentration. This signal is converted into a digital signal by an analog/digital converter 122, the output of which is fed into one of the input ports 128 of the microcontroller 114.

The temperature dependent resistance of the thermistor in the temperature detector unit 112 is similarly sampled by a second analog/digital converter 124 when activated. The output of this second converter is received at another input port 128 of the microcontroller 114.

The microcontroller itself has an arithmetic logic unit (ALU) 126 that, based upon instructions held in a program memory 132, operates on the data from the input ports 128 and a data register memory 130. It signals the alarm condition on the alarm output line 134.

A sleep interval timer 136, typically internal to the microcontroller 114, controls the time over which the detector unit 100 is powered-down between sampling intervals. The microcontroller 114 can program this timer with a desired sleep period. At the expiration of this period, the timer signals the microcontroller, which reactivates itself. This helps to reduce the amount of power consumed by the device 100.

Figure 2:
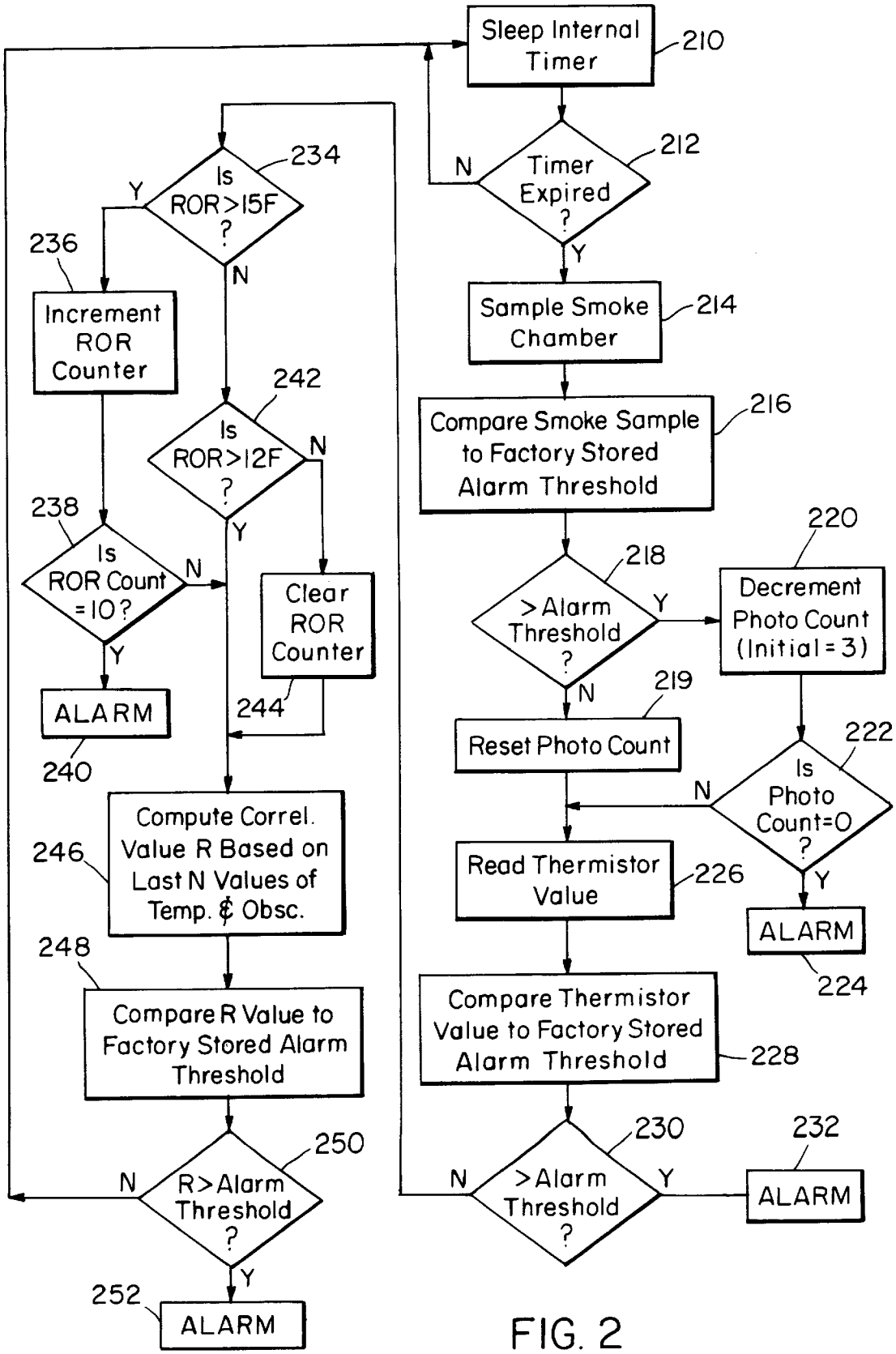
FIG. 2 is a flow diagram illustrating the operation of the inventive detector.

FIG. 2 illustrates the operation of the detector 100. In steps 210 and 212, the sleep interval timer 136 repeatedly checks for the expiration of the sleep period. Once this period has expired, the microcontroller becomes active and samples the smoke in the detection chamber in step 214. This operation includes turning-on the light emitting diode 116 and then detecting the signal response from the photodiode 118. The analog/digital converter 122 converts the photodiode's response into a digital signal that is received at the input port of the microcontroller 114.

The sampled digital value from the smoke sensing unit 110 is compared in step 216 to a factory-stored smoke alarm threshold which is stored in the program memory 132 of the microcontroller 114. The smoke alarm threshold, represents the response of the photodiode 118 that would correspond to an unacceptably high level of smoke, indicating the presence or high likelihood of a fire.

If the sampled smoke value is determined to be less than this smoke alarm threshold in step 218, a photocount is reset to three in step 219. If the threshold is exceeded, then the photocount variable is decremented in step 220. In step 222, it is determined whether the photocount is equal to 0. If the photocount is not equal to 0, then the process continues, but if it is equal to 0, then the alarm is generated in step 224. The result of steps 220 and 222 is that an alarm due to smoke will not occur unless three successive samples have exceeded the smoke alarm threshold. This removes some risk of an alarm condition because of transient smoke or other suspended particles in the air.

The temperature is next read in step 226 by sampling the resistance of the thermistor 112 and converting the result into a digital temperature value. The digital temperature value is compared to a factory stored temperature alarm threshold in step 228. This threshold corresponds to the unacceptably high temperature that would be indicative of a high probability of fire. If the temperature alarm threshold is exceeded, then the alarm condition is set in step 232. The detector 100 does not wait for a number of samples to exceed the temperature threshold before the alarm is sounded. Temperature detection tends to be very insensitive to false alarms. While one could imagine situations in which the smoke detector may transiently exceed the smoke alarm threshold, such as from someone blowing a cigarette toward the detector or transient cooking smoke, situations in which a false temperature alarm are generated are acceptably rare.

Alarm condition can also be generated in response to the rate of temperature rise. The rate of rise is determined by the microcontroller 114 by comparing the current sample from the temperature sensing unit 112 to its previous samples. If the rate of rise is determined to be greater than 15° F. per minute in step 234, a rate of rise counter is incremented in step 236 and the rate of rise count is compared to 10 in step 238. If that rate of rise has been exceeded in more than ten sampling periods, the alarm is generated in step 240.

Returning back to step 242, if the rate of rise is less than 15° F. per minute in step 224, it is then determined whether the rate of rise is greater than 12° F. per minute. If this condition is not satisfied, then the rate of rise counter is cleared in step 244. In effect, the rate of rise counter is cleared whenever the rate of rise falls below 12° per minute.

In summary, the above described steps will set the alarm condition in any one of three different situations: 1) if the threshold level of smoke has been detected on three recent samples; 2) if the temperature threshold is exceeded; or 3) if the rate of rise threshold has been satisfied in 10 recent samples. Thus, the detector's performance is never worse than systems relying on any one of these three fire detection techniques.

The detector 100, however, also compares changes in the level of smoke to the changes in the environmental temperature over time in step 246 to identify trends in the data according to statistical analysis. If the changes in the smoke and the temperature are changing together, or correlated, for a given period of time, there is a high likelihood of fire even though the net amount of smoke or the temperature would be below the corresponding alarm thresholds. Various environmental factors may cause the temperature to rise quickly or the smoke detection unit to detect smoke. As a result, the corresponding thresholds need to be set high enough so that false alarms are acceptably uncommon. It is a rare event, however, that would cause the smoke detector to detect increasing amounts of smoke simultaneously with increases in the detected temperature. In these cases, an alarm condition or pre-alarm warning can be set even when the separate smoke, temperature, and rate of rise are individually sub-threshold.

The cross correlation value $R_1$ calculated in step 246 is preferably calculated according to the following formula:

$$R_1 = \frac{S_{XY}}{\sqrt{S_X S_Y}} \tag{1}$$

$S_X$ corresponds to the sum of squares, for the last N samples, of the difference between the sampled obscuration levels X and the average of the samples $\overline{X}$ as defined by the following equation:

$$S_X = \sum_{i=1}^{N} (X_i - \overline{X})^2 \tag{2}$$

$S_Y$ corresponds to the sum of the squares for the last N samples of the difference between the temperature samples Y and the average of the temperature samples $\overline{Y}$ across the N samples:

$$S_Y = \sum_{i=1}^{N} (Y_i - \overline{Y})^2 \tag{3}$$

Finally, $S_{XY}$ is calculated according to the following formula:

$$S_{XY} = \left[\sum_{i=1}^{N} (X_i Y_i)\right] - N\overline{X}\,\overline{Y} \tag{4}$$

The variable N is preferably as large as possible for accuracy, but limitations in the practical size of the system memory restricts the variable to between 4 and 10.

The foregoing equations, however, simply represent one method for quantifying the level of correlation between the output signals from the smoke and heat sensing units 110, 112. For example, a covariance $R_2$ could alternatively be generated according to the following formula:

$$R_2 = N^{-1} \sum_{i=1}^{N} (X_i - \overline{X})(Y_i - \overline{Y}) \tag{5}$$

The specific statistical function used has little impact on the detector's operation as long as the trends in the data from the sensors can be quantified.

The correlation value R is compared to a factory stored correlation alarm threshold in step 248. If this threshold is exceeded in step 250, the alarm condition is set.

Figure 3:
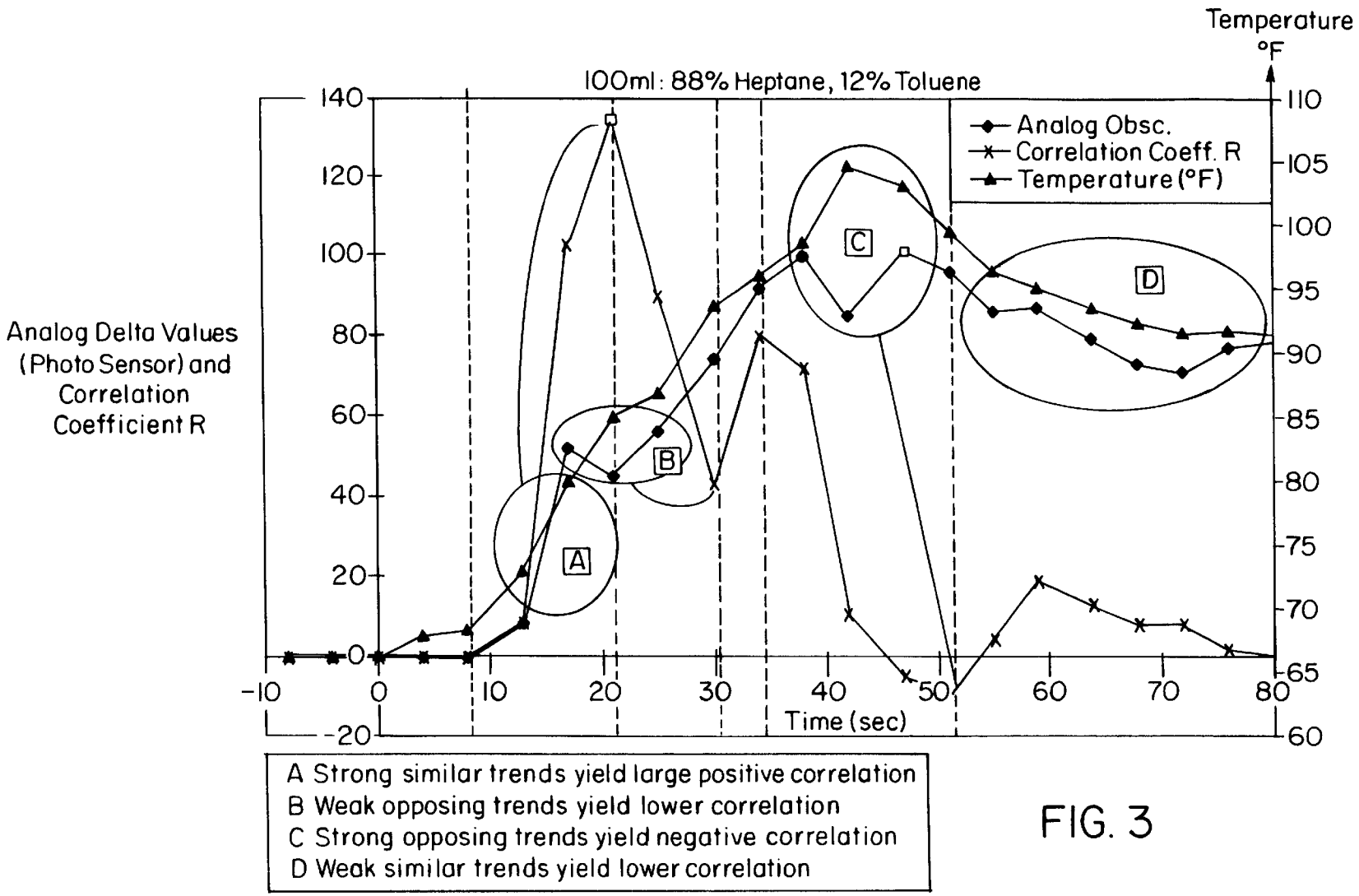
FIG. 3 is a graph of the obscuration, temperature, and correlation coefficient as a function of time for a test fire.

FIG. 3 is a graph comparing the detected levels of obscuration ♦ and the temperature ▲ along with the correlation coefficient X for these two characteristics. These are actual measured results for a test fire of 100 milliliters of 88% heptane and 12% toluene set in a fire laboratory.

Between 1 and 10 seconds, the temperature and the level of obscuration are fairly constant. This yields a low correlation coefficient R since the coefficient is sensitive to the simultaneous changes in the measured characteristics from their mean values. Region A, between 10 and 20 seconds, exhibits strong trends for both the level of obscuration and the temperature. This results in a correlation coefficient peak at approximately 20 seconds. The correlation coefficient is most responsive when the sample characters are experiencing large changes with time that are occurring contemporaneously with each other. In region B, opposing trends, the drop in the obscuration while the temperature continues to increase, results in a lower correlation coefficient at approximately 30 seconds. The coefficient R does begin to increase again as the trends no longer oppose each other. Subsequently, in region C at approximately 40 seconds, the obscuration and temperature are strongly decoupled driving the correlation coefficient negative. Finally, in region D, the weak similar trends yield a very small correlation R.

If the smoke and temperature thresholds in the example were set for 3% obscuration per foot and 135° F. respectively, and a temperature rate of rise at 20° F./min, the absolute temperature alarm would never be triggered since the temperature peaks at approximately 105° F. Similarly, the rate of rise of the temperature never satisfies the 20° F./min since, to trigger the alarm, this trend must be maintained over 10 samples. 3% obscuration is reached at approximately 47 seconds as shown by the open square sample. The cross correlation coefficient R, however, peaks very quickly at approximately 21 seconds. Thus, by generating an alarm in response to the cross correlation, an alarm is generated twice as fast as smoke detection alone.

Table 1 below shows the results for a number of different fires having varying concentrations of heptane and toluene and a smoldering wood fire. As shown, the smoke sensing unit tends to be relatively insensitive to the clean burning heptane and in many cases will not generate an alarm. The rate of rise detectors are slightly more effective in these situations, but the temperature alarm never reaches the 135° trigger point. In all instances, the cross correlation coefficient will trigger an alarm and do so earlier than the smoke, rate of rise or temperature threshold detection.

| Description | Photo | 15° F. ROR | 20° F. ROR | max temp | R | Value of Peak correlation R |
|---|---|---|---|---|---|---|
| 100 ml Heptane | no alarm | 60 sec | | 82 F. | 29 sec | 16.5 |
| 50 ml: 94% Heptane 6% Toluene | no alarm | no alarm | no alarm | 75 F. | 17 sec | 22.2 |
| 100 ml: 94% Heptane 6% Toluene | no alarm | no alarm | no alarm | 82 F. | 60 sec | 8.6 |
| 100 ml: 88% Heptane 12% Toluene | 52 sec | 40 sec | no alarm | 93 F. | 12 sec | 63.8 |
| 100 ml: 88% Heptane 12% Toluene | 48 sec | 47 sec | | 87 F. | 13 sec | 62.7 |
| Smoldering Wood Fire | 3100 sec | no alarm | no alarm | 64 F. | 2090 sec | 20 |

While this invention has been particularly shown and described with references to preferred embodiments thereof, it will be understood by those skilled in the art that various changes in form and detail may be made therein without departing from the spirit and scope of the invention as defined by the appended claims. Of course, the invention can also be implemented in an analog sensor configuration in which the smoke and temperature sensing units are located remotely from a control panel, which decides whether to set the alarm condition. In this case, the sensing units transmit analog data packets to the control panel in response to a polling signal. The control panel stores past data for each sensing unit and performs the cross correlations between sensor responses. As another modification, the smoke and temperature sensors could compare the current samples against a running average, instead of a factory set threshold, for the generation of an alarm condition. The approach has the advantage of desensitizing the individual sensors to aging of the electronics and accumulation of dirt or dust in the smoke detection chamber, for example.

We claim:

1. A fire alarm system comprising:

a smoke sensing unit which detects a smoke associated with fire;

a temperature sensing unit which detects temperature changes associated with fire; and a controller which compares a quantity of detected smoke to a smoke threshold, the temperature level to a temperature threshold, a rate of rise of the temperature level to a rate threshold, and determines combined changes in the quantity of detected smoke and the temperature changes over time, and which sets an alarm condition based upon any one of 1) the quantity of detected smoke passing the smoke threshold, 2) the temperature level passing the temperature threshold, 3) the rate of rise of the temperature level exceeding the rate threshold, or 4) when the changes in the quantity of detected smoke over time coupled with the temperature changes over time are indicative of a fire.

2. A fire alarm system as described in claim 1, wherein the controller sets an alarm condition based upon the combined changes in the detected quantity of smoke and the temperature level by performing a cross correlation.

3. A fire alarm system as described in claim 1, wherein the controller sets an alarm condition based upon the combined changes in the detected quantity of smoke and the temperature level by performing a covariance.

4. A fire alarm system as described in claim 3, wherein the smoke sensing unit is a photoelectric smoke sensor.

5. A fire alarm system as described in claim 1, wherein the controller sets an alarm condition in response to the detection of smoke only after the detected quantity of smoke exceeds the smoke threshold for longer than a single sampling period.

6. A fire alarm system as described in claim 1, wherein the temperature sensing unit comprises a thermistor.

7. A fire alarm system as described in claim 1, wherein the controller sets an alarm condition in response to the detection of the rate of rise of the temperature only after the detected rate of rise exceeds the rate threshold for longer than a single sampling period without falling below a lower rate threshold.

8. A fire alarm system as described in claim 1, wherein at least one of the smoke and temperature thresholds is based on a running average.

9. A method for detecting fire and setting a fire alarm condition, the method comprising:

detecting a quantity of smoke possibly associated with fire;

setting an alarm condition in response to the detected quantity of smoke;

detecting a temperature level;

setting an alarm condition in response to the temperature level;

comparing changes in the detected quantity of smoke over time and the detected temperature level over time;

setting an alarm condition if the changes are indicative of a fire;

tracking a rate of rise of the detected temperature level; and setting an alarm condition if the rate of temperature rise exceeds a rate threshold.

10. A method as described in claim 9, wherein the steps of setting an alarm condition in response to the detected quantity of smoke and the temperature level comprise comparing the detected quantity of smoke and the temperature level to smoke and temperature thresholds, respectively.

11. A method as described in claim 9, wherein the step of comparing the changes in the detected quantity of smoke and the temperature level comprises performing a cross correlation between the detected quantity of smoke and the temperature level over time.

12. A method as described in claim 9, wherein the step of comparing the changes in the detected quantity of smoke and the temperature level comprises performing a covariance between the detected quantity of smoke and the temperature level over time.

13. A method as described in claim 10, wherein the step of setting an alarm condition if the detected quantity of smoke exceeds the smoke threshold comprises setting the alarm condition only after the detected smoke exceeds the smoke threshold for longer than a single sampling period.

14. A method as described in claim 4, wherein the step of setting an alarm condition if the rate of temperature rise exceeds the rate threshold comprises setting the alarm condition only after the detected rate of temperature rise exceeds the rate threshold for longer than a single sampling period.

* * * * *

UNITED STATES PATENT AND TRADEMARK OFFICE

CERTIFICATE OF CORRECTION

PATENT NO. : 6,195,011 B1
DATED : February 27, 2001
INVENTOR(S) : Charles B. Winterble and Rony R. Seyouri It is certified that error appears in the above-identified patent and that said Letters Patent is hereby corrected as shown below:

Column 10, claim 14,
Line 9, change "claim 4" to -- claim 9 --.

Signed and Sealed this

Twentieth Day of November, 2001

*Attest:*

Nicholas P. Godici

NICHOLAS P. GODICI
*Acting Director of the United States Patent and Trademark Office*

*Attesting Officer*